US010508382B1

(12) United States Patent
Lonnecker

(10) Patent No.: US 10,508,382 B1
(45) Date of Patent: Dec. 17, 2019

(54) SQUEEZE PIN

(71) Applicant: Bruce Lonnecker, Golden, CO (US)

(72) Inventor: Bruce Lonnecker, Golden, CO (US)

( * ) Notice: Subject to any disclaimer, the term of this patent is extended or adjusted under 35 U.S.C. 154(b) by 0 days.

(21) Appl. No.: 16/135,944

(22) Filed: Sep. 19, 2018

Related U.S. Application Data

(60) Provisional application No. 62/694,509, filed on Jul. 6, 2018.

(51) Int. Cl.
*D06F 55/00* (2006.01)
*A44B 9/12* (2006.01)

(52) U.S. Cl.
CPC ..... *D06F 55/00* (2013.01); *A44B 9/12* (2013.01)

(58) Field of Classification Search
CPC ..... D06F 55/00; A44B 9/12; Y10T 24/203; Y10T 24/204
See application file for complete search history.

(56) References Cited

U.S. PATENT DOCUMENTS 734,735 A 7/1903 Mcgill
748,189 A * 12/1903 Hoy ..... D06F 55/00 24/533
1,281,779 A * 10/1918 Hunter ..... A44B 9/12 24/707.8
2,018,198 A * 10/1935 Baggett ..... D06F 55/00 24/555
2,714,238 A 8/1955 Sappey
3,411,190 A * 11/1968 Augier ..... B60R 13/043 24/293
3,982,307 A 9/1976 Smith et al.
4,324,025 A * 4/1982 Apri ..... B42F 1/08 24/551
4,497,091 A * 2/1985 Elliott ..... B42F 1/08 24/30.5 T
4,761,862 A * 8/1988 Hiromori ..... B42F 1/04 24/67.5
5,331,507 A * 7/1994 Kyung ..... H01L 23/4093 174/16.3
5,533,236 A * 7/1996 Tseng ..... B42F 1/006 24/67 R
5,638,583 A * 6/1997 Tseng ..... B42F 1/006 24/499
5,657,519 A 8/1997 Smith
6,823,565 B2 * 11/2004 Toye ..... A01G 13/0293 24/265 H
D537,331 S * 2/2007 Hill ..... D8/395
8,050,429 B2 * 11/2011 Caploon ..... H04R 1/028 24/67 R
D729,542 S * 5/2015 Dontfraid ..... D6/534
9,080,281 B2 7/2015 Earley, III
9,511,615 B2 * 12/2016 Isserstedt ..... B42F 1/006
9,816,540 B2 * 11/2017 Smullen ..... F16B 2/22
(Continued)

FOREIGN PATENT DOCUMENTS

GB 110790 A * 10/1917 ..... A41F 1/00

*Primary Examiner* — Robert Sandy
*Assistant Examiner* — Louis A Mercado

(57) ABSTRACT

A squeeze pin has a spring-wire structure having an upper horizontal span, mirror-image side portions extending downward from opposite ends of the upper horizontal span, and lower portions proceeding from lower ends of the side portions first inward, and then back outward, ending at engagement points presented in opposite directions, substantially parallel with the upper horizontal span.

9 Claims, 6 Drawing Sheets

(56) References Cited

U.S. PATENT DOCUMENTS

| | | | | |
|---|---|---|---|---|
| 10,342,301 | B1 * | 7/2019 | Terry | A45F 5/02 |
| 10,414,198 | B2 * | 9/2019 | Matsushita | B42F 1/02 |
| 2001/0032376 | A1 * | 10/2001 | Payne | B42F 1/006 24/67.5 |
| 2007/0175006 | A1 * | 8/2007 | Chen | D06F 55/00 24/545 |

* cited by examiner

SQUEEZE PIN

CROSS-REFERENCE TO RELATED APPLICATIONS

The present application claims priority to Provisional Patent Application 62/694,509, filed Jul. 6, 2018, titled Squeeze Pin. Said Provisional is herein incorporated by reference.

BACKGROUND OF THE INVENTION

1. Field of the Invention

The present invention is in the technical area of sewing artifacts, and pertains more particularly to a pin with opposed points, and spring characteristics, for holding fabric layers.

2. Description of Related Art

Safety pins and straight pins for holding otherwise separate layers of fabric together are well-known in the art. With either a straight pin or a safety pin it is typically necessary to use both hands, one to hold the fabric layers together, and the other to insert the point of the pin through the layers, usually in at least two places. This is a rather clumsy operation, and often a user will jab his or her own finger with the point of the pin. Additional problems arise for elderly users, users with arthritis or users with disabilities that have challenges with motor skills. Users with vision problems also may find it difficult to use fabric pins known in the art What is clearly needed is a pin that is of a relatively large, or conveniently sized graspable shape and may be operated with one hand to engage layers of fabric, plastic or other material layers.

BRIEF SUMMARY OF THE INVENTION

In one embodiment of the invention a squeeze pin is provided, comprising a spring-wire structure having an upper horizontal span, mirror-image side portions extending downward from opposite ends of the upper horizontal span, and lower portions proceeding from lower ends of the side portions first inward, and then back outward, ending at engagement points presented in opposite directions, substantially parallel with the upper horizontal span.

In one embodiment the wire is flattened in the lower portions leading to the engagement points. In one embodiment the squeeze pin further comprises inward indentions in the side portions, providing gripping positions for a user to grip and squeeze the pin. Also in one embodiment gripping pads are added on the opposite side portions, providing gripping surfaces for a user to grip and squeeze the pin.

In another aspect of the invention a squeeze pin is provided, comprising a contiguous plastic structure having an upper horizontal span, mirror-image plastic side portions extending downward from opposite ends of the upper horizontal span, plastic lower portions proceeding from lower ends of the side portions first inward, and then back outward, ending at engagement points presented in opposite directions, substantially parallel with the upper horizontal span.

In one embodiment of the plastic squeeze pin the material is flattened in the lower portions leading to the engagement points. Also in one embodiment the plastic squeeze pin comprises inward indentions in the side portions, providing gripping positions for a user to grip and squeeze the pin.

Also in one embodiment gripping pads are added on the opposite side portions, providing gripping surfaces for a user to grip and squeeze the pin.

In another aspect of the invention a method for joining layers of fabric is provided, comprising gripping a squeeze pin having a spring-wire or plastic structure with an upper horizontal span, mirror-image side portions extending downward from opposite ends of the upper horizontal span, and lower portions proceeding from lower ends of the side portions first inward, and then back outward, ending at engagement points presented in opposite directions, substantially parallel with the upper horizontal span, by the side portions, urging the side portions inward by pressure, causing the engagement points to be drawn closer together, and to point downward rather than horizontal, pushing the engagement points into layers of fabric, and releasing the pressure, allowing the side portions to proceed apart, catching and engaging the fabric layers together.

DETAILED DESCRIPTION OF THE INVENTION

Figure 1:
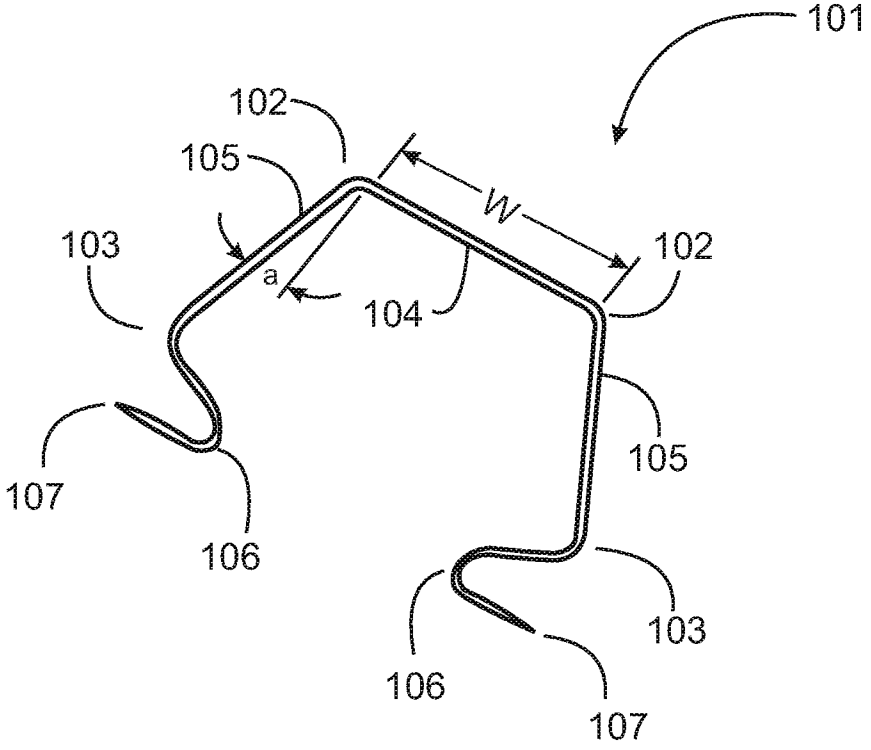
FIG. 1 is a plan view of a squeeze pin in one embodiment of the present invention.

FIG. 1 is a plan view of a pin 101 in one embodiment of the present invention. In this embodiment the pin is formed from a single length of usually round and malleable wire, which may be between 0.5-0.7 mm, for example. In this example the straight piece of wire is bent at two places 102 at obtuse inside angles of somewhat more than ninety degrees. Bend angles may be smaller or larger while maintaining the function of the pin 101. Angle a may be about ten degrees, for example, and may be the same on both sides, with dimension W of top side 104 being about 0.75 inches. These measurements may vary in other embodiments, depending to some degree on intended use of the pin. Also, in some embodiments the diameter of the wire for the pin may differ, which may depend in part on intended force to compress the pin in use.

In forming pin 101, bends 103 are accomplished as well, again providing inside obtuse angles of somewhat less than ninety degrees, and bends 106 are accomplished so that points 107 face horizontally away from one another and generally parallel to top side 104. Points 107 are formed to points, to penetrate fabric layers, and may not extend outward beyond bends 103. In an alternative embodiment, the points 107 may extend past bends 103.

Once the shape of pin 101 is established with malleable wire, the shaped pin may be heat treated to temper the material and provide a spring rate, such that the structure will return to the relaxed shape shown in FIG. 1 if released after being compressed or extended in either direction.

Figure 2:
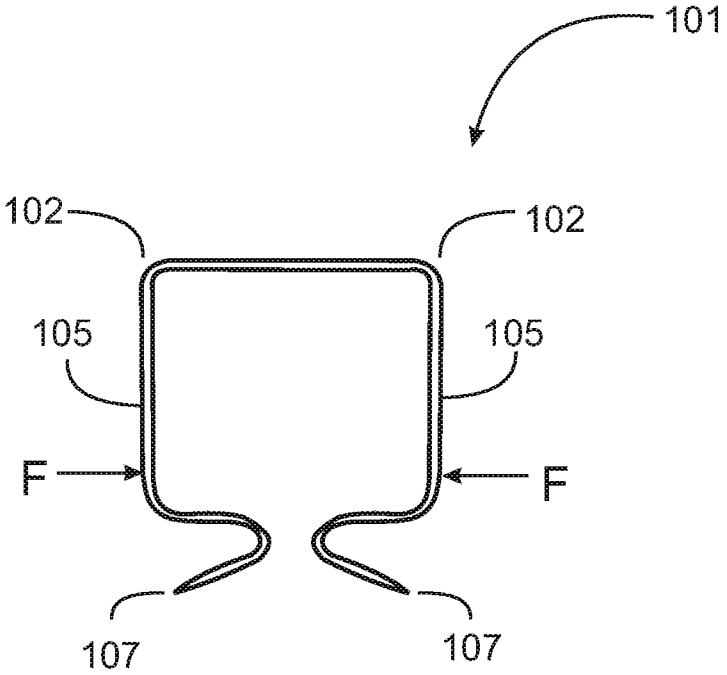
FIG. 2 is a plan view of the squeeze pin of FIG. 1, compressed.

FIG. 2 shows pin 101 compressed by inward forces F at or near bends 103, as may be applied by a person grasping the pin between thumb and forefinger. Sufficient force has been applied to deflect sides 105 around bends 102, such that sides 105 are now substantially vertical and parallel. Less force would leave sides 105 extending outward, thereby increasing a diameter between bends 106 (FIG. 1) and more force would leave sides 105 extending more inward, thereby decreasing a diameter between bends 106 (FIG. 2). The direction of points 107 is now somewhat downward, as opposed to the parallel aspect when uncompressed.

Figure 3B:
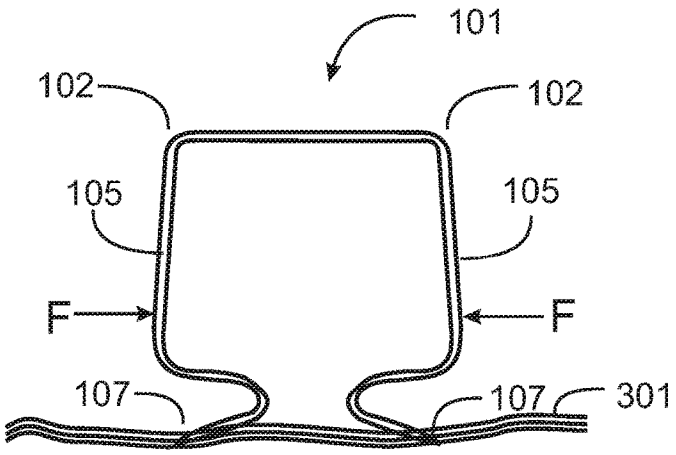
FIG. 3B shows the pin of FIG. 2 with squeezing pressure partially released, the points engaging layers of fabric.
Figure 3C:
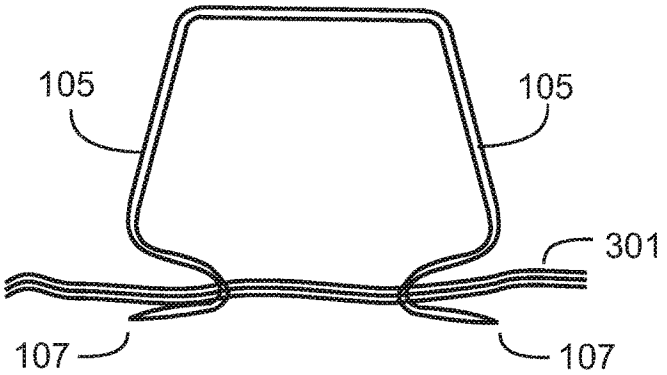
FIG. 3C shows the pin of FIG. 2 with the pressure fully released, and the layers of fabric captured by the pin.
Figure 3A:
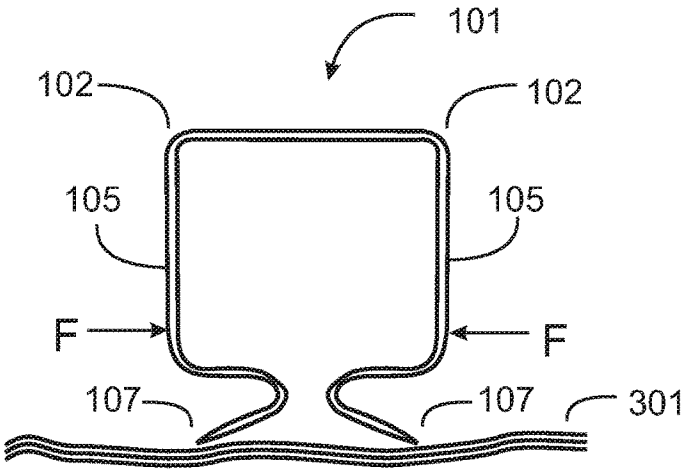
FIG. 3A shows the pin of FIG. 2 proximate layers of fabric.

FIG. 3A shown the pin 101 of FIG. 2, held compressed by a person, proximate layers of fabric 301. In FIG. 3B the person holding the squeeze pin has pressed the pin downward until points 107 have penetrated the layers of fabric. In FIG. 3C the person has released the pin, which has extended back toward the relaxed state, until the fabric, having been penetrated by both points, restrains the pin from further relaxation. At this point the fabric is holding the pin still partly compressed. These three figures illustrate use of thee squeeze pin in an embodiment of this invention to join and hold several layers of fabric.

Figure 4:
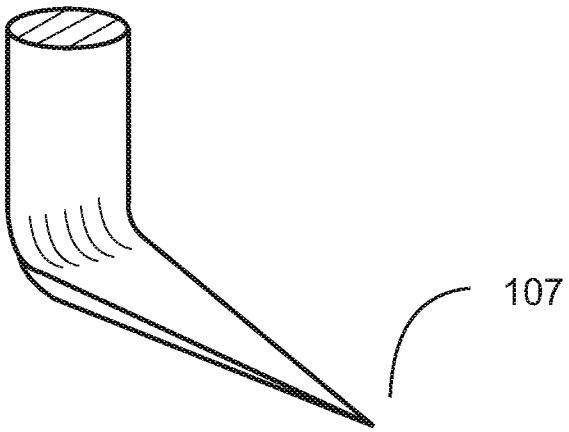
FIG. 4 shows a flattened point on a squeeze pin.
Figure 5:
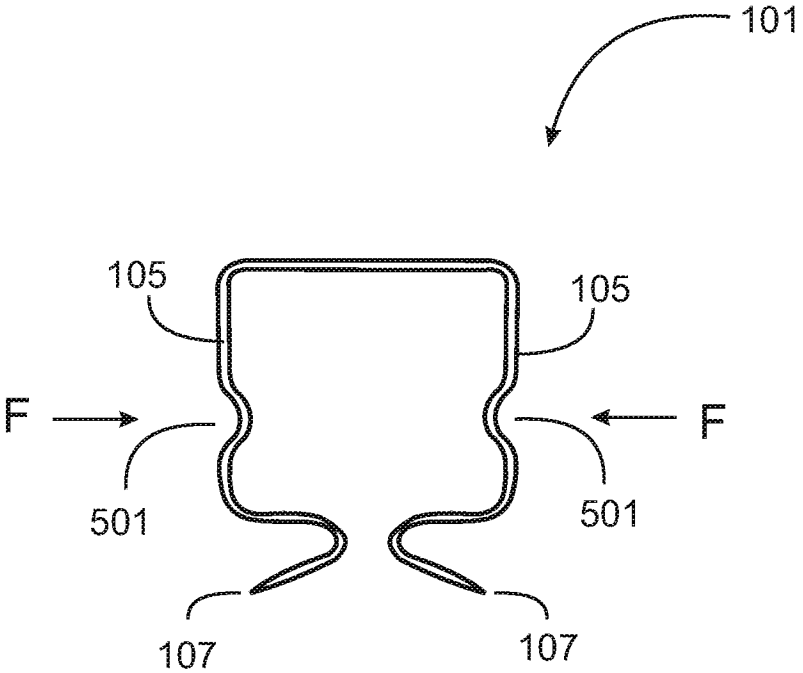
FIG. 5 shows a squeeze pin, compressed, with indentions for better grip.
Figure 6B:
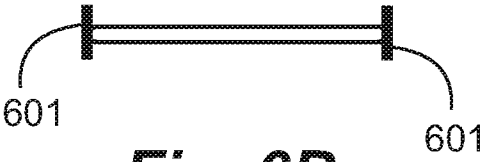
FIG. 6B shows a top view of the pin of FIG. 3A.
Figure 6A:
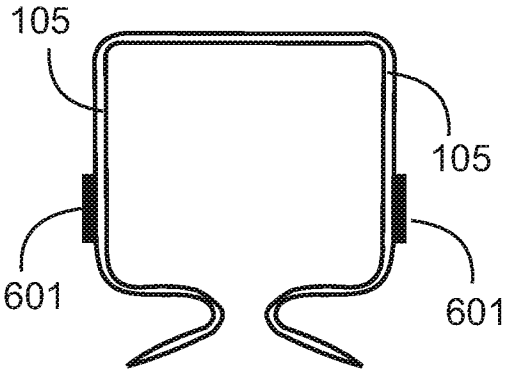
FIG. 6A shows a squeeze pin, compressed, with added pads for grip, in an elevation view.

In some embodiments points 107 are simply sharp points formed on the end of round wire used to make the squeeze pin. In some embodiments, the points are flattened as shown in FIG. 4, which shows one point 107 at an angle to see the flattened aspect. FIG. 5 illustrates an embodiment wherein extra bends 501 have been made to provide a better grip for the thumb and fingers of a user. FIG. 6A illustrates an embodiment wherein metal or plastic pads 601 are added at the position that a user will grip, again to facilitate the process of gripping for the user. FIG. 6B shows a top view of pin 101 of FIG. 6A.

In some embodiments of the invention the pin, except for the points and area near the points, may be coated with, for example, a plastic or lacquer material. In these embodiments different colors may be accomplished.

The skilled person will be aware that the embodiments described herein are examples only, and do not encompass all possible implementations within the scope o the invention. Different orientations of portions of the pin may be provided, dimensions may be different, and materials may differ as well. In one embodiment, for example, the material may be plastic rather than metal wire. The invention is limited only by the claims that follow.

I claim:

1. A squeeze pin, comprising:

a spring-wire structure having an upper horizontal span;

mirror-image side portions extending downward from opposite ends of the upper horizontal span; and lower portions proceeding from lower ends of the side portions first inward, and then back outward, ending at sharp engagement points presented in opposite directions, substantially parallel with the upper horizontal span;

wherein the spring-wire structure lies within a plane.

2. The squeeze pin of claim 1 wherein the wire is flattened in the lower portions leading to the engagement points.

3. The squeeze pin of claim 1 further comprising inward indentions in the side portions, providing gripping positions for a user to grip and squeeze the pin.

4. The squeeze pin of claim 1 wherein gripping pads are added on an opposite of the side portions, providing gripping surfaces for a user to grip and squeeze the pin.

5. A squeeze pin, comprising:

a contiguous plastic structure having an upper horizontal span;

mirror-image plastic side portions extending downward from opposite ends of the upper horizontal span; and plastic lower portions proceeding from lower ends of the side portions first inward, and then back outward, ending at sharp engagement points presented in opposite directions, substantially parallel with the upper horizontal span;

wherein the contiguous plastic structure lies within a plane.

6. The squeeze pin of claim 5 wherein a material is flattened in the lower portions leading to the engagement points.

7. The squeeze pin of claim 5 further comprising inward indentions in the side portions, providing gripping positions for a user to grip and squeeze the pin.

8. The squeeze pin of claim 5 wherein gripping pads are added on an opposite of the side portions, providing gripping surfaces for a user to grip and squeeze the pin.

9. A method for joining layers of fabric, comprising:

gripping a squeeze pin having a spring-wire or plastic structure with an upper horizontal span, mirror-image side portions extending downward from opposite ends of the upper horizontal span, and lower portions proceeding from lower ends of the side portions first inward, and then back outward, ending at engagement points presented in opposite directions, substantially parallel with the upper horizontal span, by the side portions;

urging the side portions inward by pressure, causing the engagement points to be drawn closer together, and to point downward rather than horizontal;

pushing the engagement points into the layers of fabric; and releasing the pressure, allowing the side portions to proceed apart, catching and engaging the layers of fabric together.

* * * * *